US009267717B2

(12) United States Patent
Sapp et al.

(10) Patent No.: US 9,267,717 B2
(45) Date of Patent: Feb. 23, 2016

(54) SYSTEM AND METHOD OF CHARGE MANAGEMENT

(75) Inventors: Gary Lee Sapp, Tyler, TX (US); Darryl Elliott Denton, Tyler, TX (US); Jason Thomas LeRoy, Tyler, TX (US); John Bailey, Huntersville, NC (US); Roy Randall Crawford, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 741 days.

(21) Appl. No.: 13/529,758

(22) Filed: Jun. 21, 2012

(65) Prior Publication Data

US 2013/0340451 A1 Dec. 26, 2013

(51) Int. Cl.

| | |
|---|---|
| ***F25B 45/00*** | (2006.01) |
| ***F28F 9/02*** | (2006.01) |
| ***F25B 39/04*** | (2006.01) |
| ***F28D 1/053*** | (2006.01) |
| *F25B 40/02* | (2006.01) |
| *F28D 21/00* | (2006.01) |

(52) U.S. Cl.

CPC ..... *F25B 39/04* (2013.01); *F28D 1/05391* (2013.01); *F25B 40/02* (2013.01); *F25B 2339/044* (2013.01); *F25B 2500/23* (2013.01); *F25B 2500/29* (2013.01); *F28D 2021/0068* (2013.01)

(58) Field of Classification Search

CPC .. F28F 9/0231; F25B 2345/001; F25B 43/00; F25B 40/02; F25B 45/00

See application file for complete search history.

(56) References Cited

U.S. PATENT DOCUMENTS

| | | | | |
|---|---|---|---|---|
| 1,376,519 | A * | 5/1921 | Du Laney | F22D 5/24 137/157 |
| 3,077,927 | A * | 2/1963 | White | F01P 11/0238 123/41.15 |
| 3,085,626 | A * | 4/1963 | Bognar | F22B 1/06 159/28.3 |
| 4,182,133 | A * | 1/1980 | Haas | F24F 3/1405 62/160 |
| 4,998,416 | A | 3/1991 | Van Steenburgh, Jr. | |
| 5,088,294 | A * | 2/1992 | Ando | F25B 39/04 165/110 |

(Continued)

FOREIGN PATENT DOCUMENTS

| | | | |
|---|---|---|---|
| CN | 102087134 | A * | 6/2011 |
| CN | 102645256 | A * | 8/2012 |

(Continued)

OTHER PUBLICATIONS

Keeprite Incorporated; CEA No. 007 U 207; "Commercialization of Improved Residential Air Source Heat Pumps Phase I & II;" Report for Canadian Electrical Association; Mar. 1988; 99 pages.

(Continued)

*Primary Examiner* — Frantz Jules
*Assistant Examiner* — Erik Mendoza-Wilkenfel
(74) *Attorney, Agent, or Firm* — Conley Rose, P.C.; J. Robert Brown, Jr.; Michael J. Schofield

(57) ABSTRACT

A heat exchanger has an upper region, a lower region disposed vertically lower than the upper region, and a passive charge management device. The passive charge management device has an internal volume, an upper tube connecting the internal volume to at least one of the upper region and the lower region at a first vertical height, and a lower tube connecting the internal volume to at least one of the upper region and the lower region at a second vertical height that is vertically lower than the first vertical height.

17 Claims, 6 Drawing Sheets

(56) References Cited

U.S. PATENT DOCUMENTS

| | | | | |
|---|---|---|---|---|
| 5,546,761 | A | 8/1996 | Matsuo et al. | |
| 5,619,861 | A | 4/1997 | Yamanaka et al. | |
| 5,884,503 | A | 3/1999 | Inaba | |
| 5,927,102 | A | 7/1999 | Matsuo et al. | |
| 6,003,410 | A | 12/1999 | Judge et al. | |
| 6,378,323 | B1 * | 4/2002 | Chavagnat | 62/324.4 |
| 6,845,626 | B2 * | 1/2005 | Matsuoka et al. | 62/149 |
| 7,891,201 | B1 * | 2/2011 | Bush | F25B 1/10 62/115 |
| 2002/0059806 | A1 * | 5/2002 | Nobuta et al. | 62/509 |
| 2005/0183451 | A1 * | 8/2005 | Roston | 62/509 |
| 2006/0101835 | A1 * | 5/2006 | Meldahl | B60H 1/00585 62/149 |
| 2006/0137370 | A1 * | 6/2006 | Kang et al. | 62/149 |
| 2008/0283215 | A1 * | 11/2008 | Saida | B60H 1/00828 165/43 |
| 2008/0296005 | A1 * | 12/2008 | Taras | F25B 13/00 165/173 |
| 2009/0145218 | A1 * | 6/2009 | Wells | G01F 23/0046 73/290 R |
| 2009/0272135 | A1 * | 11/2009 | Nishimura | F25B 13/00 62/149 |
| 2010/0025028 | A1 * | 2/2010 | Shinhama | F25B 39/04 165/174 |
| 2010/0181058 | A1 * | 7/2010 | Huazhao | F28D 1/05383 165/173 |
| 2011/0192176 | A1 * | 8/2011 | Kim et al. | 62/115 |
| 2011/0198065 | A1 * | 8/2011 | Hanafusa | 165/173 |
| 2012/0111547 | A1 * | 5/2012 | Suzuki | F25B 39/04 165/173 |

FOREIGN PATENT DOCUMENTS

| | | | |
|---|---|---|---|
| JP | H08219589 | A | 8/1996 |
| JP | H109713 | A | 1/1998 |
| JP | 11132651 | A * | 5/1999 |
| JP | H11351704 | A | 12/1999 |
| JP | 2000213825 | A | 8/2000 |
| JP | 2010190545 | A * | 9/2010 |

OTHER PUBLICATIONS

Mexican Office Action; Application No. MX/a/2013/006655; Jul. 17, 2015; 6 pages.

Chinese Office Action; Application No. 201310248138.9; Mar. 9, 2015; 17 pages.

* cited by examiner

SYSTEM AND METHOD OF CHARGE MANAGEMENT

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Some heating, ventilation, and/or air conditioning (HVAC) systems comprise microchannel heat exchangers. In some cases, HVAC systems comprising microchannel heat exchangers may respond to ambient temperatures with significant fluctuations in subcooling and/or compressor discharge pressure.

SUMMARY OF THE DISCLOSURE

In some embodiments of the disclosure, a heat exchanger is provided that comprises an upper region, a lower region disposed vertically lower than the upper region, and a passive charge management device. In some embodiments, the passive charge management device may comprise an internal volume, an upper tube connecting the internal volume to at least one of the upper region and the lower region at a first vertical height, and a lower tube connecting the internal volume to at least one of the upper region and the lower region at a second vertical height that is vertically lower than the first vertical height.

In other embodiments of the disclosure, a method of refrigerant charge management is disclosed. The method may comprise providing a microchannel heat exchanger, introducing liquid phase refrigerant into the microchannel heat exchanger, filling the microchannel heat exchanger with refrigerant to a threshold vertical height, and introducing additional liquid phase refrigerant into the microchannel heat exchanger to exceed the threshold vertical height and to receive liquid phase refrigerant into a passive charge management device.

In yet other embodiments of the disclosure, an HVAC system comprising a condenser heat exchanger, a compressor configured to pump refrigerant to the condenser heat exchanger, and a passive charge management device in fluid communication with the condenser heat exchanger at least at two different vertical locations is disclosed. The passive charge management device may be configured to receive liquid phase refrigerant from the condenser heat exchanger when a vertical height of liquid refrigerant within the condenser heat exchanger exceeds a threshold vertical height.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

FIG. 8 is a chart that shows that the addition of a passive charge management device decreases compressor discharge pressure over a range of outdoor ambient temperatures.

DETAILED DESCRIPTION

Some HVAC systems comprising a microchannel heat exchanger that is utilized as a refrigerant condenser may respond to increases in ambient temperature with undesirable increases in subcooling and/or compressor discharge pressure. In some cases, the undesirable increases in subcooling and/or compressor discharge pressure may be attributed to excess migration of liquid phase refrigerant from an evaporator and/or liquid line to the condenser during high outdoor ambient temperature conditions. Accordingly, this disclosure provides systems and methods for decreasing the undesirable increases in subcooling and/or compressor discharge pressure by providing a passive charge management device that receives excess liquid phase refrigerant and prevents recirculation of the received refrigerant throughout the remainder of the closed loop refrigerant system.

Figure 1:
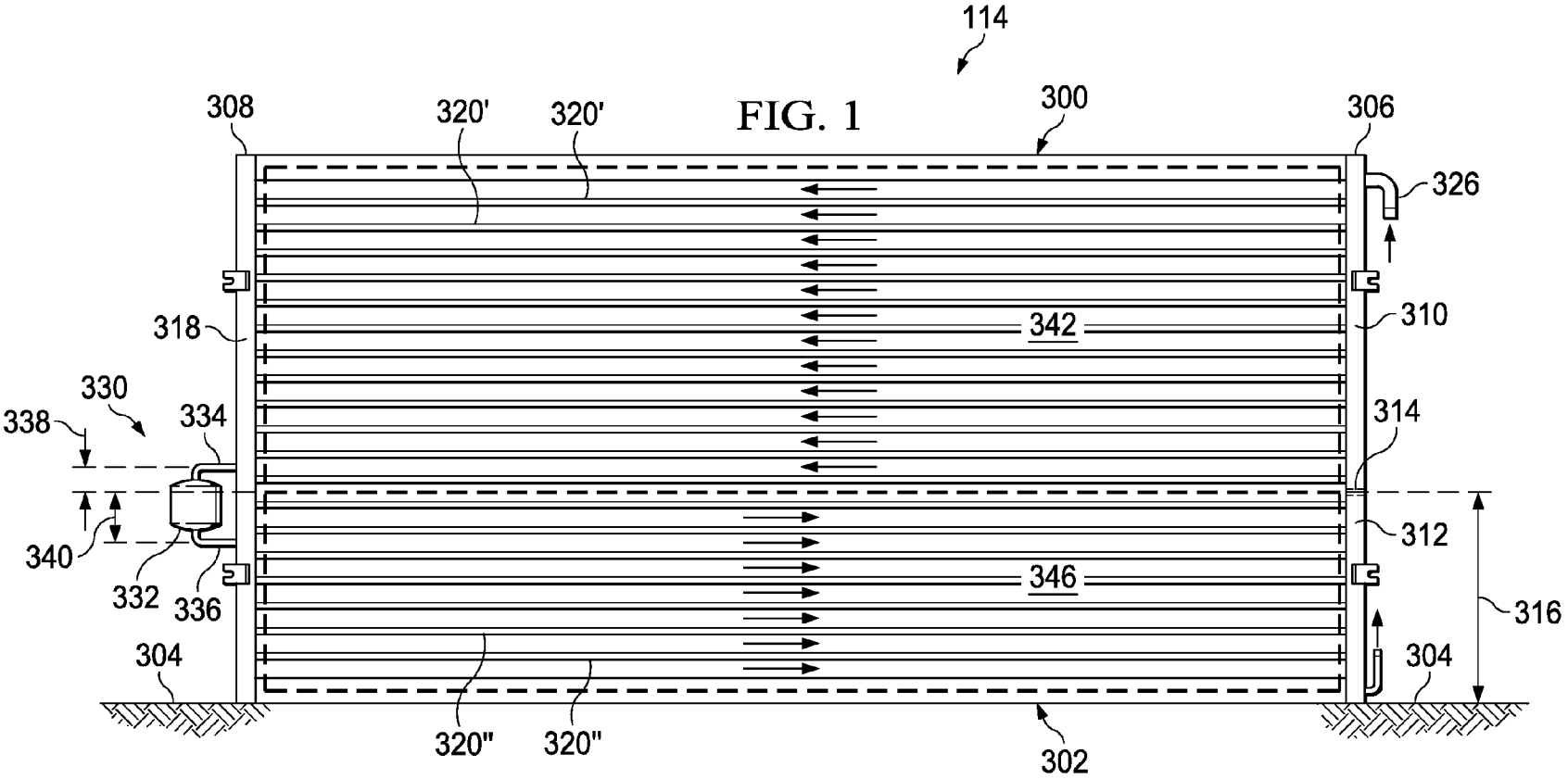
FIG. 1 is an orthogonal front view of an outdoor heat exchanger according to an embodiment of the disclosure.

Referring now to FIG. 1, a simplified orthogonal front view of an outdoor heat exchanger 114 for an HVAC system is shown. While the outdoor heat exchanger 114 is shown in an unbent configuration, the outdoor heat exchanger 114 may alternatively be bent into a C-shape, U-shape, circular shaped, and/or any other suitable configuration to complement the remainder of an outdoor unit. The outdoor heat exchanger 114 generally comprises an upper end 300 and a lower end 302. The lower end 302 is generally configured to be vertically lower than the upper end 300, and in some embodiments, the lower end 302 may be located in close proximity to a support surface 304 that supports the outdoor unit 104.

The outdoor heat exchanger 114 further comprises a divided header 306 and an undivided header 308. The divided header 306 is generally a tubular structure comprising an upper volume 310 and a lower volume 312. The upper volume 310 and the lower volume 312 are separated and prevented from directly communicating fluid between each other by a divider 314 disposed within the divided header 306. In alternative embodiments, the divided header 306 may be replaced by two physically separate headers. In this embodiment, the divider 314 is generally located a divider vertical offset distance 316 from the lower end 302. The undivided header 308 comprises a substantially similar tubular structure to that of the divided header 306, but the undivided header 308 comprises no internal structure analogous to the divider 314. Accordingly, the undivided header 308 comprises a substantially vertically continuous volume 318. The outdoor heat exchanger 114 further comprises a plurality of microchannel tubes 320 that extend horizontally between the divided header 306 and the undivided header 308. The microchannel tubes 320 join the divided header 306 and the undivided header 308 in fluid communication with each other.

Figure 2:
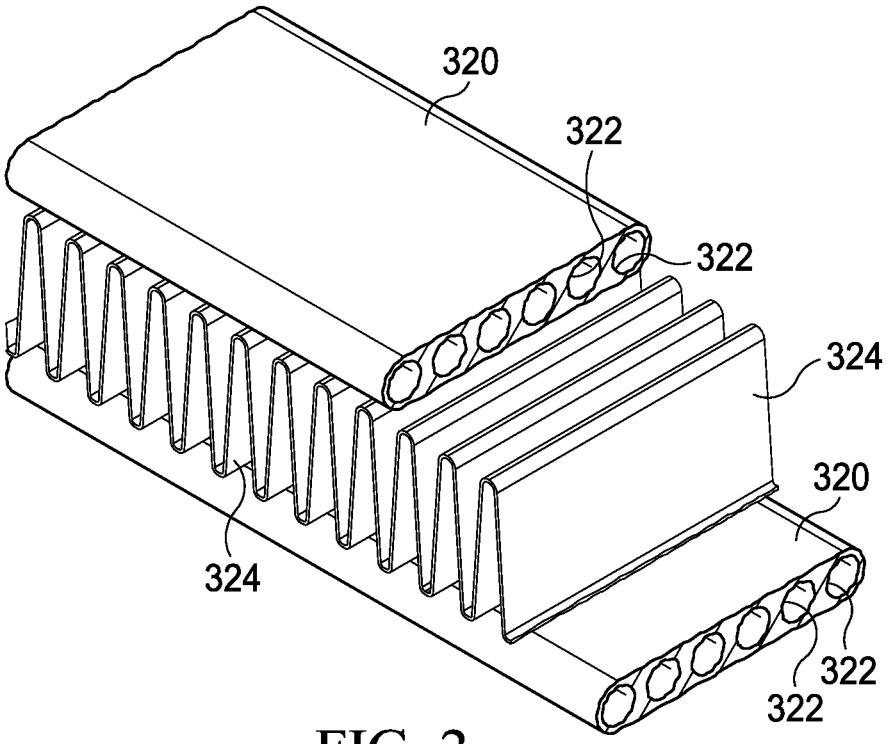
FIG. 2 is a partial cutaway oblique view of a plurality of microchannel tubes of the outdoor heat exchanger of FIG. 1.

Referring now to FIG. 2, a partial cutaway oblique view of a plurality of microchannel tubes 320 is shown. In this embodiment, each microchannel tube 320 comprises a plurality of substantially parallel microchannels 322. Further, vertically adjacent microchannel tubes 320 may be joined to intermediately disposed thermally conductive fins 324.

Referring back to FIG. 1, the thermally conductive fins 324 are not shown for clarity. The microchannel tubes 320 that supply refrigerant from the divided header 306 to the undivided header 308 may be referred to as supply microchannel tubes 320' while the microchannel tubes 302 that supply refrigerant from the undivided header 308 to the divided header 306 may be referred to as return microchannel tubes 320". The outdoor heat exchanger 114 further comprises a refrigerant inlet tube 326 in substantially direct fluid communication with an upper portion of the upper volume 310 of the divided header 306. The outdoor heat exchanger 114 also comprises a refrigerant outlet tube 328 in substantially direct fluid communication with a lower portion of the lower volume 312 of the divided header 306. Still further, the outdoor heat exchanger 114 comprises a passive charge management device 330 associated with the undivided header 308.

The passive charge management device 330 may comprise a refrigerant reservoir 332 joined in fluid communication with the undivided header 308 by (1) an upper tube 334 at a upper offset distance 338 relative to the vertical height 316 of the divider 314 and (2) a lower tube 336 at a lower offset distance 340 relative to the vertical height of the divider 314. In some embodiments, the vertical height 316 of the divider 314 may generally provide a division between supply microchannel tubes 320' and return microchannel tubes 320". In the embodiment shown in FIG. 1, a majority of the total volumetric space of the passive charge management device 330 is located adjacent to and vertically below the vertical height 316 of the divider 314. In some embodiments, the refrigerant reservoir 332 may comprise a substantially cylindrical shape. As will be described below in greater detail, the passive charge management device 330 may serve to selectively remove excess refrigerant from circulation within the HVAC system. In some cases, the excess charge may be attributable to overcharging the system with too much refrigerant, while in other cases, the excess charge may merely be characterized as excess charge because undesirably high outdoor ambient temperatures have caused liquid phase refrigerant to enter the outdoor heat exchanger 114 via inlet tube 326.

Figure 3:
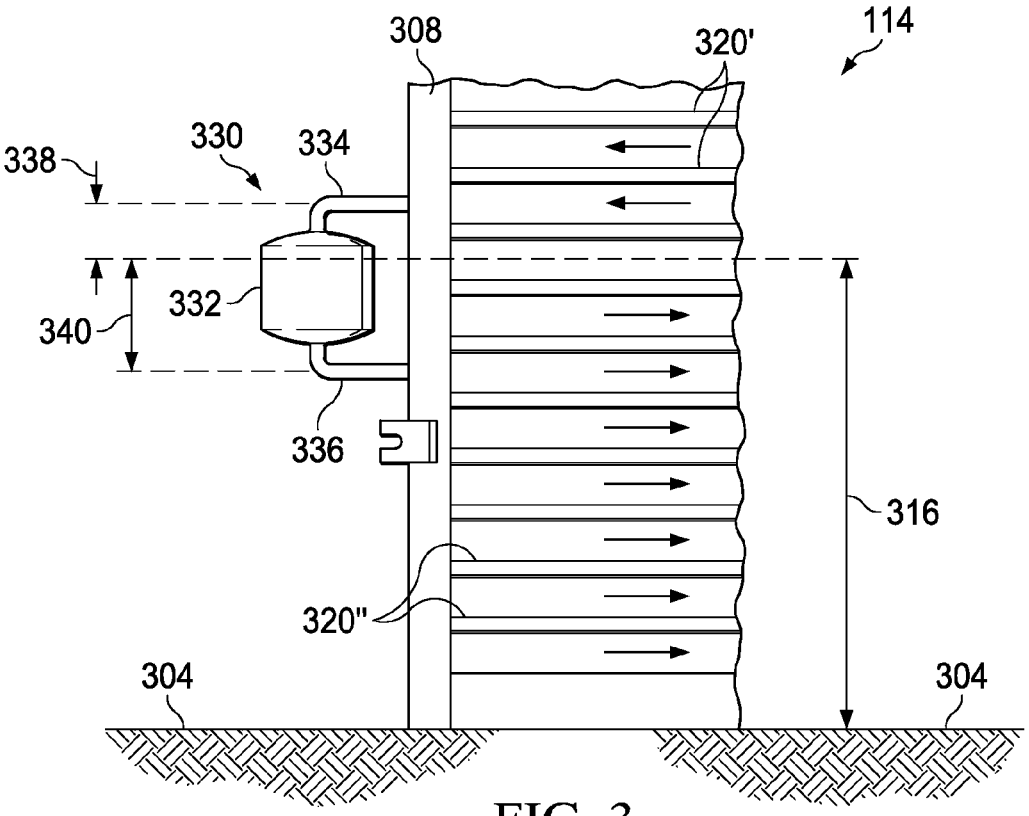
FIG. 3 is a partial cutaway orthogonal view of the outdoor heat exchanger of FIG. 1.

Referring now to FIGS. 1 and 2, various operating conditions of the heat outdoor heat exchanger 114 will be described. FIG. 3 provides a simplified partial cutaway orthogonal view of the outdoor heat exchanger 114, including the passive charge management device 330. Under normal and/or ideal operating conditions, the outdoor heat exchanger 114 may be generally described as comprising two regions, an upper region 342 and a lower region 346. Because, under ideal and/or normal conditions, refrigerant is introduced into the outdoor heat exchanger 114 as hot gas, the hot gas will normally fill the upper volume 310 of the divided header 306 and travel in parallel paths through the supply microchannel tubes 320'. As the hot gas is cooled by ambient outdoor air being forced into contact with the outdoor heat exchanger 114, some of the hot gas may cool and condense to liquid form. Most generally, a substantial amount of such initial condensation and conversion to liquid may occur in the upper region 342. When the condensed liquid reaches the undivided header 308, the liquid refrigerant may fall into the continuous volume 318 of the undivided header and become distributed into the various return microchannel tubes 320" before exiting the outdoor heat exchanger 114. Under these normal and/or ideal conditions, the liquid level in the undivided header 308, return microchannel tubes 320", and passive charge management device 330 may extend up to about the bottom of the refrigerant reservoir 332.

However, when either (1) the HVAC system is overcharged with too much refrigerant and is operating under normal and/or ideal ambient temperature operating conditions, (2) the HVAC system is properly charged but is operating under very high ambient temperature operating conditions, or (3) the HVAC system is both overcharged and is operating under very high ambient temperature operating conditions, the refrigerant behavior may be different. Most notably, under the three above-described conditions, some refrigerant may be introduced into the outdoor heat exchanger 114 as substantially single phase liquid.

For comparison, in a substantially similar outdoor heat exchanger 114 that does not comprise a passive charge management device 330, upon receiving the liquid refrigerant, the liquid level may resultantly rise into an uppermost portion of the lower region 346 or even higher by backing up into the upper region 342. In some embodiments, significant efficiency losses occur when large quantities of single phase liquid refrigerant fills portions of the upper region 342. Further, such excess single phase liquid refrigerant may undesirably cause higher subcooling and/or higher compressor discharge pressures, in some cases ultimately causing a compressor that pumps refrigerant to the outdoor heat exchanger 114 and/or receives refrigerant from the outdoor heat exchanger 114 to shut off due to excessively high discharge pressure. However, instead of suffering the above-described efficiency losses and/or causing compressor shut offs, the embodiment of FIGS. 3 and 5 receives liquid refrigerant into the passive charge management device 330 and thereby reduces the effective refrigerant charge of the HVAC system.

Still referring to FIGS. 1 and 2, as the liquid refrigerant level increasingly rises above the lowest portion of the interior volume of the lower tube 336, the passive charge management device 330 reduces the effective charge of the HVAC system by gradually filling the passive charge management device 330 with the excess liquid phase refrigerant. The passive charge management device may be provide a sufficient total volume to prevent substantial backup of liquid phase buildup into the upper region 342. The precise vertical location of the passive charge management device 330 relative to the height 316 of the divider 314 and/or to the generalized vertical division between the lower region 346 and the upper region 342 may be altered with varying affects. In some embodiments the passive charge management device 330 may be located higher, thereby potentially allowing some filling of the upper region 342 and reducing the effectiveness of the upper region 342 when excessive charge is present. In other embodiments, the passive charge management device 330 may be located lower, thereby potentially reducing the effectiveness of the upper portions of the lower region 346 when excessive charge is not present.

Figure 4:
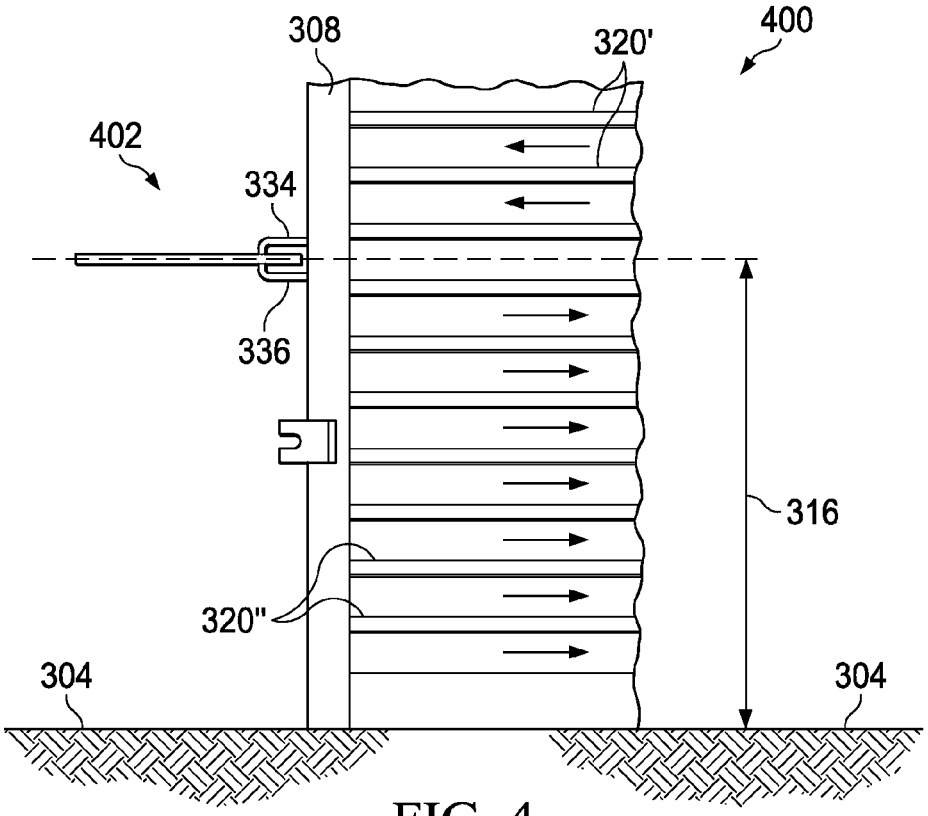
FIG. 4 is a partial cutaway orthogonal view an outdoor heat exchanger according to another embodiment of the disclosure.

Referring now to FIG. 4, an alternative embodiment of an outdoor heat exchanger 400 is shown. The outdoor heat exchanger 400 is substantially similar to the outdoor heat exchanger 114 except that the passive charge management device 402 is shaped, sized, and/or vertically located differently than the passive charge management device 330. By comparatively locating more volumetric space of the interior of the passive charge management device 402 between the vertical heights of the top of the highest return microchannel tube 320" and the bottom of the lowest supply microchannel tube 320', the passive charge management device 402 may be considered to be more responsive and/or may be considered to be configured to more aggressively remove excess charge as compared to the passive charge management device 330. For example, when the outdoor heat exchanger 400 receives excessive liquid phase refrigerant, each of the return microchannel tubes 320" may be filled with liquid refrigerant prior to liquid refrigerant beginning to fill the passive charge management device 402. As the liquid level begins to rise above the highest return microchannel tube 320", liquid refrigerant may begin to rise within both the undivided header 308 and the passive charge management device 402 to provide the benefits described above with regard to passive charge management device 330.

However, because the passive charge management device 402 is located vertically below the bottom of the lowest supply microchannel tube 320', the filling of the passive charge management device 402 may occur without a related backing up of liquid refrigerant into the upper region 342. Instead, the entire volume of the passive charge management device 402 may be completely filled prior to backing up liquid refrigerant into the upper region 342 thereby avoiding the associated efficiency losses until after the utilization of the passive charge management device 402 has been maximized and still more liquid phase refrigerant is introduced into the outdoor heat exchanger 400. While such an embodiment of a passive charge management device 402 may be relatively more sensitive to proper leveling of the outdoor heat exchanger 400, the desired volume of the passive charge management device 402 may be primarily located within a round or square tube bent to conform to an inner or outer profile of the outdoor heat exchanger 114 and/or an inner profile of a housing of an outdoor unit.

While the passive charge management devices 330, 402 are described with particular geometries and relative height locations, this disclosure contemplates that any other suitable size, shape, location, and/or orientation may be selected knowing that the selections may affect outdoor heat exchanger 114, 400 efficiency in different manners. For example, increasingly locating volume of a passive charge management device in vertical alignment with upper region 342 may cause increasing losses of efficiency of upper regions 342 before the passive charge management device is filled and has thereby provided its full benefit of removing a maximum amount of refrigerant from circulation. Conversely, increasingly locating volume of a passive charge management device in vertical alignment with the lower region 346 may increasingly require an excessive charge to be present for the lower region to be fully utilized, leading to a different type of inefficiency and/or underutilization.

Figure 5:
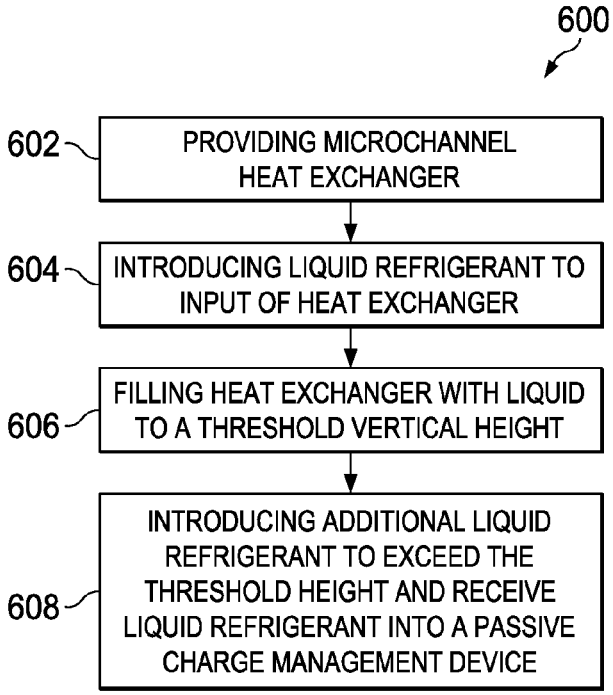
FIG. 5 is a flow chart of a method of charge management according to an embodiment of the disclosure.

Referring now to FIG. 5, a flowchart of a method 600 of refrigerant charge management is shown. The method 600 may begin at block 602 by providing a small diameter and/or low volume heat exchanger such as a microchannel outdoor heat exchanger 114. After providing the microchannel heat exchanger at block 602, the method may progress to block 604.

At block 604, the method 600 may progress by introducing liquid refrigerant to an input of the heat exchanger 114. In some embodiments, such introduction may be caused as a result of high ambient temperature and/or overcharging the HVAC system. After introducing liquid refrigerant to an input of the heat exchanger 114, the method may progress to block 606.

At block 606, the method may progress by filling the heat exchanger with liquid refrigerant to a threshold vertical height. In some embodiments, the threshold height may be a lowest vertical height of an interior space of a passive charge management device 330, 402. After filling the heat exchanger with a sufficient amount of liquid refrigerant to a threshold height, the method may progress to block 608.

At block 608, the method may progress by increasing a volume of liquid refrigerant within the heat exchanger sufficient to exceed the threshold height, thereby introducing liquid refrigerant into a passive charge management device such as passive charge management device 330, 402. By receiving the liquid refrigerant into the passive charge management device, the liquid within the passive charge management device is effectively removed from circulation and the effective charge of the HVAC system is reduced. Even if some of the liquid within the passive charge management device is exchanged with other liquid, the effective charge may remain reduced.

Figure 6:
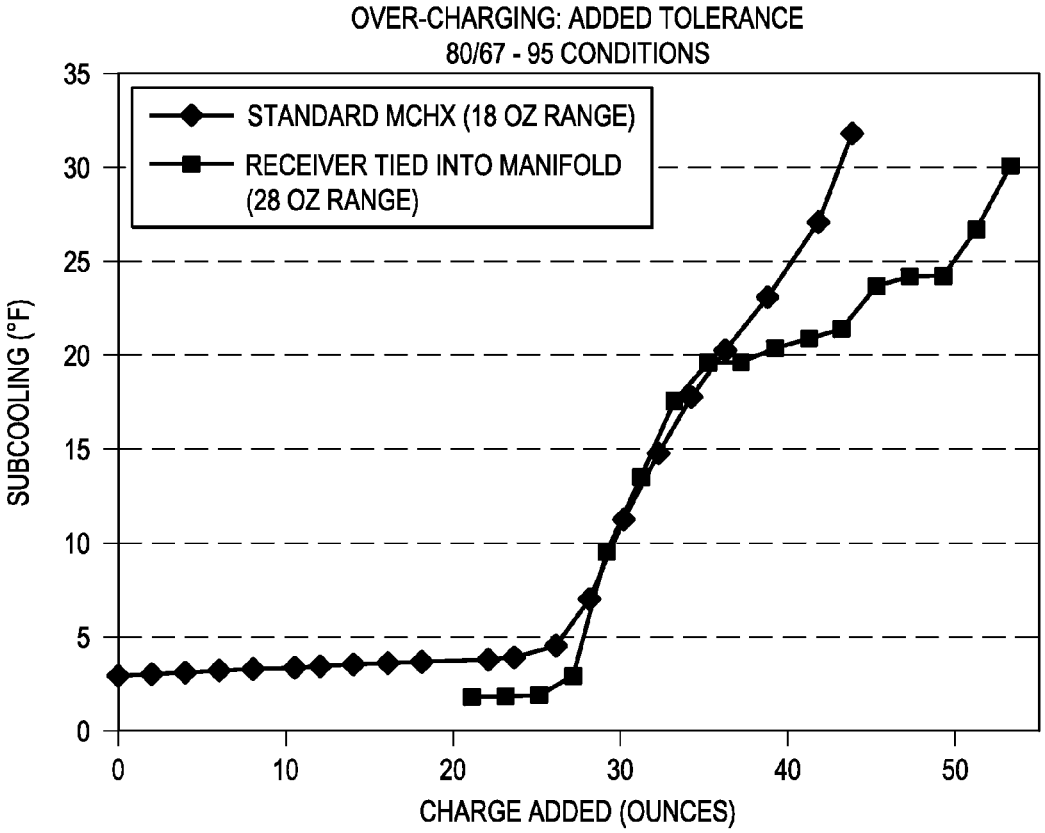

Referring now to FIG. 6, a chart is provided that shows that the addition of a passive charge management device substantially similar to passive charge management device 330 is effective in increasing an HVAC system tolerance to being overcharged with refrigerant. The test data were obtained by testing a 3.5 ton capacity HVAC system in cooling mode and operating the system a various levels of overcharging. By casual inspection, one can see that beginning at about 35 ounces of overcharging the system comprising a passive charge management device was able to delay increasing from about 20 degrees Fahrenheit of subcooling to about 25 degrees Fahrenheit of subcooling by about an additional 15 ounces of charge.

Figure 7:
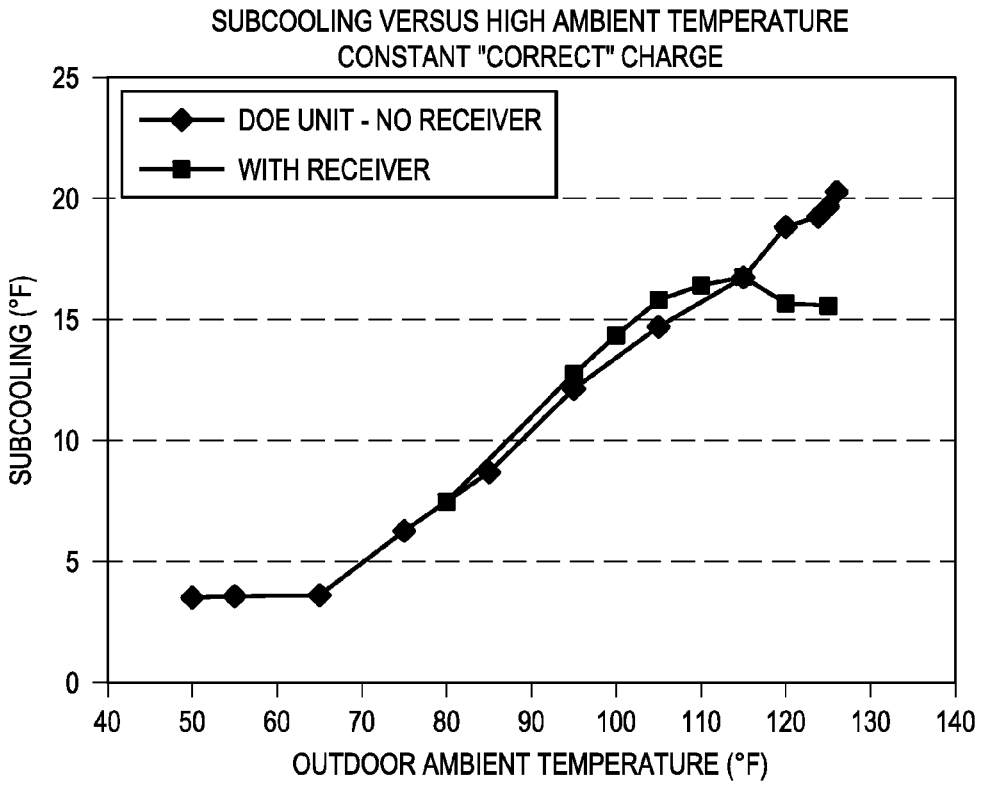
FIG. 7 is a chart that shows that the addition of a passive charge management device decreases subcooling over a range of outdoor ambient temperatures.

Referring now to FIG. 7, a chart is provided that shows that the addition of a passive charge management device substantially similar to passive charge management device 330 is effective in increasing an HVAC system tolerance to operating in very high ambient outdoor temperature conditions. The test data were obtained by testing a 3.5 ton capacity HVAC system in cooling mode and operating the system at various outdoor ambient temperatures. By casual inspection, one can see the beginning at about 115 degrees Fahrenheit, the HVAC system comprising a passive charge management device was able to provide the benefit of not only stalling but stalling an increase in subcooling but actually reduce subcooling over the temperature range of about 115 degrees Fahrenheit to about 130 degrees Fahrenheit.

Figure 8:
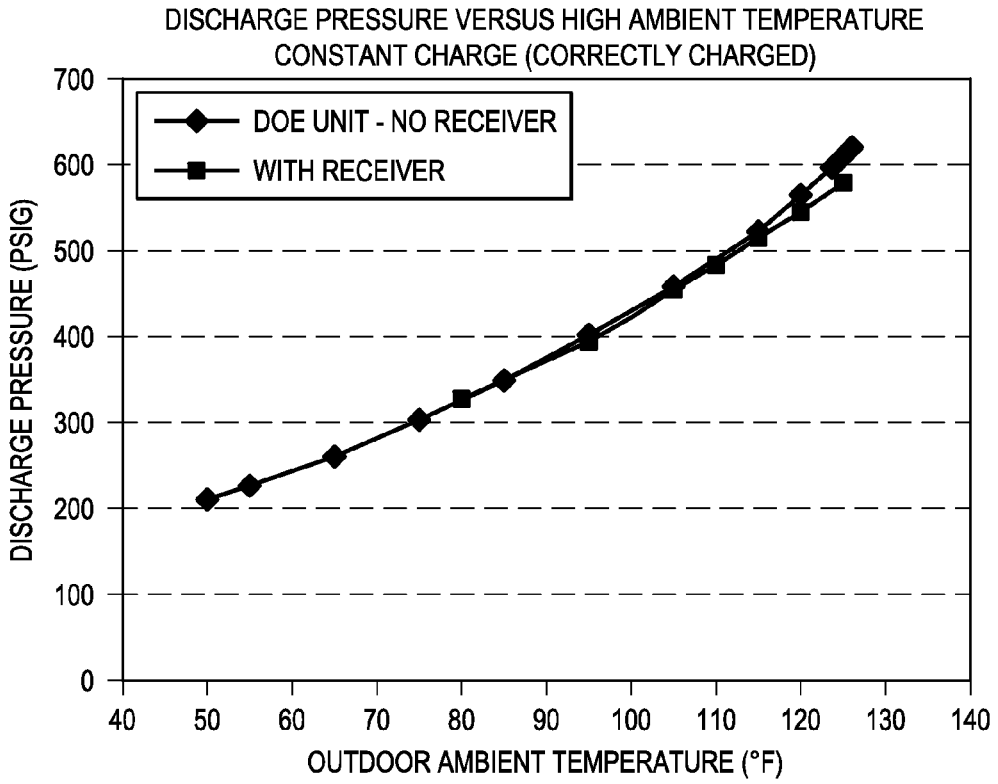
FIG. 8 is a chart that shows that the addition of a passive charge management device increases a tolerance refrigerant overcharging.

Referring now to FIG. 8, a chart is provided that shows that the addition of a passive charge management device substantially similar to passive charge management device 330 is effective in increasing an HVAC system tolerance to operating in very high ambient outdoor temperature conditions. The test data were obtained by testing a 3.5 ton capacity HVAC system in cooling mode and operating the system at various outdoor ambient temperatures. By casual inspection, one can see the beginning at about 115 degrees Fahrenheit, the HVAC system comprising a passive charge management device was able to provide the benefit of reducing a rate of increase in compressor discharge pressure over the temperature range of about 115 degrees Fahrenheit to about 130 degrees Fahrenheit.

Figure 9:
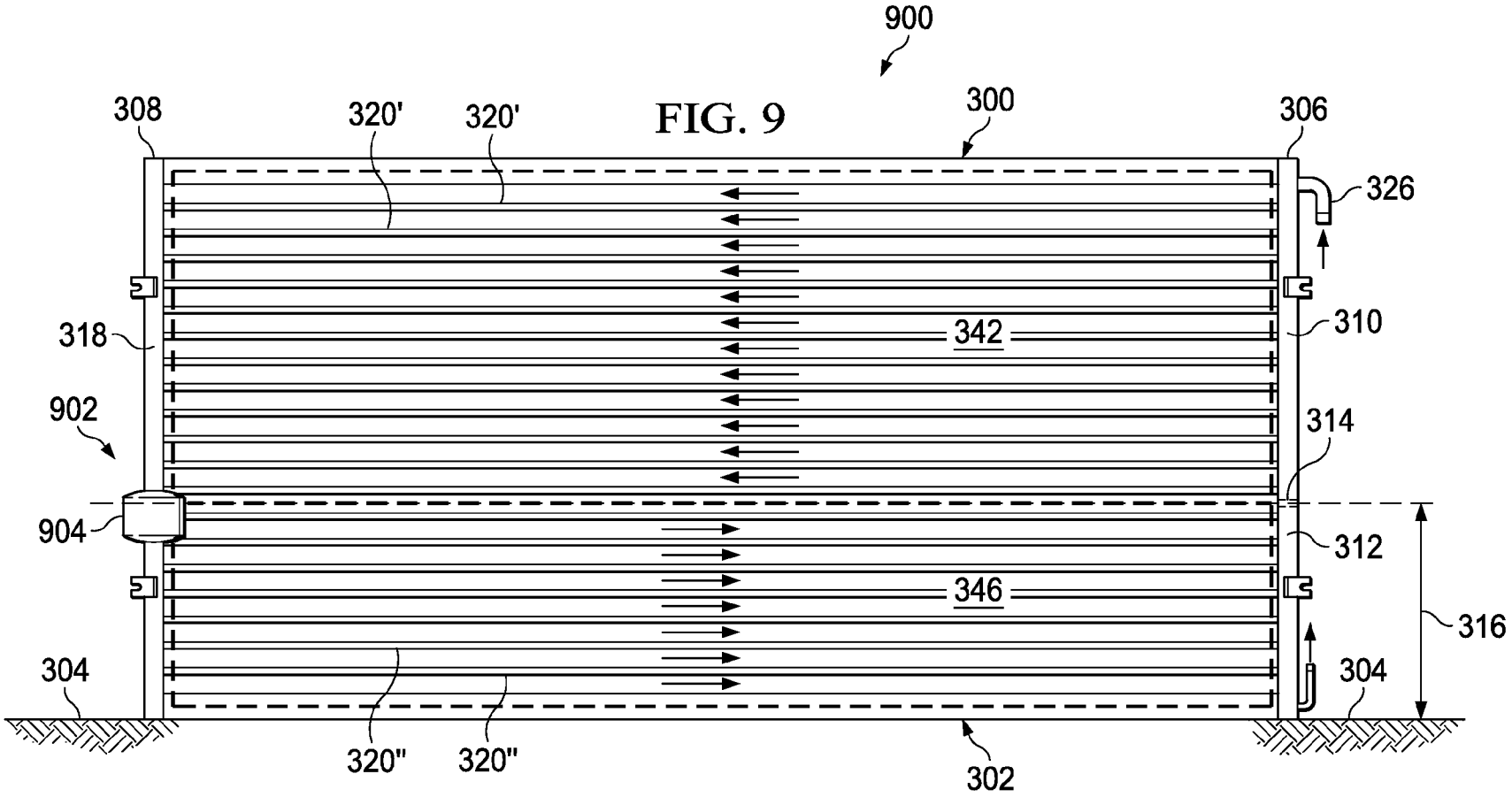
FIG. 9 is an orthogonal front view of an outdoor heat exchanger according to another embodiment of the disclosure.

Referring now to FIG. 9, a heat exchanger 900 according to another embodiment of the disclosure is shown. The heat exchanger 900 may be substantially similar to heat exchanger 114 with the exception that it comprises a passive charge management device 902 that is substantially integral to the undivided header 308. The passive charge management device 902 may comprise a generally a reservoir 904 that is generally volumetrically greater than the volumetric space within the undivided header 308 of along the same vertical length of the heat exchanger 114. In some embodiments, the passive charge management device 902 may generally comprise a cylindrical can-like structure configured for inline fluid communication with the portions of the undivided header located vertically above and below the passive charge management device. Similar to the passive charge management device 330, the passive charge management device 902 is a substantially inactive device that may provide functionality through the location of the reservoir 904 relative to the vertical height 316. In alternative embodiments, a passive charge management device may comprise any other generally localized passive and/or non-adjusting volumetric capacity increase of the undivided header 308 or any other component of the heat exchanger that generally provides a localized increased capacity to retain liquid refrigerant near the vertical height 316.

While the passive charge management devices 330, 902 are disclosed above as being configured for use with microchannel heat exchangers, in alternative embodiments, the passive charge management devices 330, 902 may similarly be used with any other relative low volume heat exchanger and/or any other heat exchanger comprising relatively small diameter tubing. Further, the passive charge management devices 330, 902 may be used with and/or integral to heat exchangers that are used for condensing refrigerant, evaporating refrigerant, and/or both, such as in the case of a heat exchanger of a heat pump HVAC system.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k*(Ru−RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heat exchanger, comprising:
an undivided header;
a divided header that comprises a divider that defines a division between an upper region comprising a plurality of supply heat exchanger tubes configured to carry refrigerant into the undivided header and a lower region comprising a plurality of return heat exchanger tubes configured to carry refrigerant from the undivided header, wherein the lower region is disposed vertically lower than the upper region; and
a passive charge management device associated with and mounted to the undivided header and comprising:
an internal volume;
an upper tube connecting the internal volume in direct fluid communication with the undivided header at a first vertical height; and
a lower tube connecting the internal volume in direct fluid communication with the undivided header at a second vertical height that is vertically lower than the first vertical height;
wherein a majority of the internal volume is located adjacent to and vertically below a vertical height of the divider defining the division between the upper region and the lower region.

2. The heat exchanger of claim 1, wherein the plurality of the supply heat exchanger tubes and the plurality of return heat exchanger tubes comprise microchannel tubes extending through the upper region and the lower region, respectively.

3. The heat exchanger of claim 1, wherein the first vertical height is at least partially vertically aligned with the upper region.

4. The heat exchanger of claim 1, wherein the second vertical height is at least partially vertically aligned with the lower region.

5. The heat exchanger of claim 1, wherein the passive charge management device comprises a reservoir that provides a majority of the internal volume of the passive charge management device and wherein the upper tube and the lower tube are in fluid communication with the reservoir.

6. The heat exchanger of claim 1, wherein the passive charge management device comprises a reservoir that is vertically aligned with a portion of each of the upper region and the lower region.

7. A method of refrigerant charge management, comprising:
providing a microchannel heat exchanger comprising an undivided header and a divided header having a divider that defines a division between an upper region comprising a plurality of supply microchannel tubes configured to carry refrigerant into the undivided header and a lower region comprising a plurality of return microchannel tubes configured to carry refrigerant from the undivided header;
introducing liquid phase refrigerant into the microchannel heat exchanger;
filling the microchannel heat exchanger with refrigerant to a threshold vertical height;
continuously introducing liquid phase refrigerant into the microchannel heat exchanger to exceed the threshold vertical height and to receive liquid phase refrigerant into an internal volume of a passive charge management device that is mounted to and in fluid communication with the undivided header, wherein a majority of the internal volume is located vertically below a vertical height of the divider of the divided header; and reducing a compressor discharge pressure in response to receiving the liquid phase refrigerant into the passive charge management device.

8. The method of claim 7, further comprising:

reducing a subcooling temperature in response to receiving the liquid phase refrigerant into the passive charge management device.

9. The method of claim 7, further comprising:

reducing a rate of increase of subcooling temperature versus an increasing ambient outdoor temperature in response to receiving the liquid phase refrigerant into the passive charge management device.

10. The method of claim 7, further comprising:

reducing a rate of increase of compressor discharge pressure versus an increasing ambient outdoor temperature in response to receiving the liquid phase refrigerant into the passive charge management device.

11. The method of claim 7, wherein the passive charge management device comprises an internal volume and wherein a majority of the internal volume is vertically located between an upper portion of a lower region of the heat exchanger and a lower portion of an upper region of the heat exchanger.

12. An HVAC system, comprising:

a condenser heat exchanger comprising an undivided header, and a divided header comprising a divider that defines a division between an upper region comprising a plurality of supply heat exchanger tubes configured to carry refrigerant into the undivided header and a lower region comprising a plurality of return heat exchanger tubes configured to carry refrigerant from the undivided header;

a compressor configured to pump refrigerant to the condenser heat exchanger; and a passive charge management device comprising an internal volume mounted to and in fluid communication with the undivided header of the condenser heat exchanger, wherein the passive charge management device is configured to receive liquid phase refrigerant into the internal volume from the undivided header of the condenser heat exchanger when a vertical height of liquid refrigerant within the undivided header of the condenser heat exchanger exceeds a threshold vertical height, and wherein a majority of the internal volume of the passive charge management device is located vertically below a vertical height of the divider defining the division between the plurality of supply heat exchanger tubes of the upper region and the plurality of return heat exchanger tubes of the lower region.

13. The HVAC system of 12, wherein the threshold vertical height is vertically aligned with a lower region of the condenser heat exchanger.

14. The HVAC system of claim 12, wherein the threshold vertical height is vertically aligned with an upper region of the condenser heat exchanger.

15. The HVAC system of claim 12, wherein the passive charge management device comprises an elongated tube reservoir vertically located substantially between a lower region of the condenser heat exchanger an upper region of the condenser heat exchanger.

16. The HVAC system of claim 12, wherein the HVAC system is a heat pump HVAC system.

17. The HVAC system of claim 12, wherein the plurality of supply heat exchanger tubes and plurality of return heat exchanger tubes comprise microchannel tubes.

* * * * *